US012599221B2

(12) United States Patent
Sant et al.

(10) Patent No.: US 12,599,221 B2
(45) Date of Patent: Apr. 14, 2026

(54) VERSATILE AMBIDEXTROUS POUCH FOR ACCESSORIES FOR AUTOMOTIVE DETAILING AND OTHER INTERCHANGEABLE TOOL USES

(71) Applicants: Thomas Sant, Sayville, NY (US); David Sant, Sayville, NY (US)

(72) Inventors: Thomas Sant, Sayville, NY (US); David Sant, Sayville, NY (US)

( * ) Notice: Subject to any disclaimer, the term of this patent is extended or adjusted under 35 U.S.C. 154(b) by 99 days.

(21) Appl. No.: 18/076,928

(22) Filed: Dec. 7, 2022

(65) Prior Publication Data

US 2024/0188705 A1 Jun. 13, 2024

(51) Int. Cl.
*A45F 3/00* (2006.01)
*A45F 5/00* (2006.01)

(52) U.S. Cl.
CPC ..... *A45F 3/005* (2013.01); *A45F 5/004* (2013.01); *A45F 2003/003* (2013.01); *A45F 5/1575* (2025.01)

(58) Field of Classification Search
CPC .. A45F 5/004; A45F 2200/0575; A45F 5/021; A45F 5/102; A45F 2005/006
See application file for complete search history.

(56) References Cited

U.S. PATENT DOCUMENTS 4,953,765 A * 9/1990 Little ..... A45F 5/00 383/902
5,232,136 A * 8/1993 Unger ..... A45F 5/02 224/904
5,730,340 A * 3/1998 Bosic ..... A45F 5/02 224/684
7,100,537 B1 * 9/2006 Suen ..... A01K 13/002 15/1.52
7,661,620 B2 * 2/2010 Fields ..... A45F 5/004 224/217
7,698,789 B2 * 4/2010 Cserpes ..... A45F 5/04 24/303
8,887,940 B2 11/2014 Kiceniuk
9,629,446 B2 * 4/2017 Moreau ..... A45F 5/102
9,675,155 B2 * 6/2017 Dai ..... A45C 15/06
RE47,263 E 3/2019 Hendrickson
10,264,874 B2 * 4/2019 Becker ..... A45F 3/14
10,442,075 B2 10/2019 Moreau
10,736,406 B2 8/2020 Hintze
10,897,943 B1 1/2021 Pagano
11,026,501 B1 6/2021 Pabrowka
(Continued)

*Primary Examiner* — Adam J Waggenspack
(74) *Attorney, Agent, or Firm* — Alfred M. Walker; Thomas A. O'Rourke; James Bongiorno

(57) ABSTRACT

A versatile ambidextrous pouch worn on the front central abdominal waist of user. provides quick access to handheld accessories for automotive detailing and other interchangeable tool uses, regardless of whether the user is right-handed or left-handed. The tool pouch enables both right-handed workers and left-handed workers to choose a primary, frequently used tool for the dominant hand of the worker and a secondary less used tool for the less dominant hand interchangeably, so that the primary tool can be advanced directly forward from the front central abdominal waist of the user, without awkwardly reaching across the abdomen to grasp a tool and move it angulary across the user's abdomen toward a work surface. Multiple other accessory tools are attached in and out of the pouch.

2 Claims, 7 Drawing Sheets

(56) References Cited

U.S. PATENT DOCUMENTS

| | | | | |
|---|---|---|---|---|
| 11,026,502 | B1 * | 6/2021 | Erold | A45F 5/02 |
| 11,103,052 | B2 * | 8/2021 | Salentine | A45F 5/00 |
| 11,253,049 | B2 | 2/2022 | Barklow | |
| D975,437 | S * | 1/2023 | Liu | D3/226 |
| D1,027,428 | S * | 5/2024 | Lin | D3/226 |
| 2004/0099705 | A1 * | 5/2004 | Skupin | A45F 5/004 224/674 |
| 2007/0210130 | A1 * | 9/2007 | Bonnell | A45F 5/021 224/677 |
| 2009/0159365 | A1 | 6/2009 | O'Brien | |
| 2009/0242598 | A1 | 10/2009 | Dormaar | |
| 2014/0262873 | A1 * | 9/2014 | Lorentz | A45F 3/02 206/315.1 |
| 2016/0010948 | A1 | 1/2016 | Gerdes | |
| 2017/0035184 | A1 * | 2/2017 | Sagel | A45D 33/008 |
| 2017/0065065 | A1 * | 3/2017 | Brewner | A45F 5/021 |
| 2017/0231375 | A1 * | 8/2017 | Moreau | B65H 75/446 224/162 |
| 2021/0145188 | A1 * | 5/2021 | Thatcher | A45F 3/04 |

* cited by examiner

Fig. 3
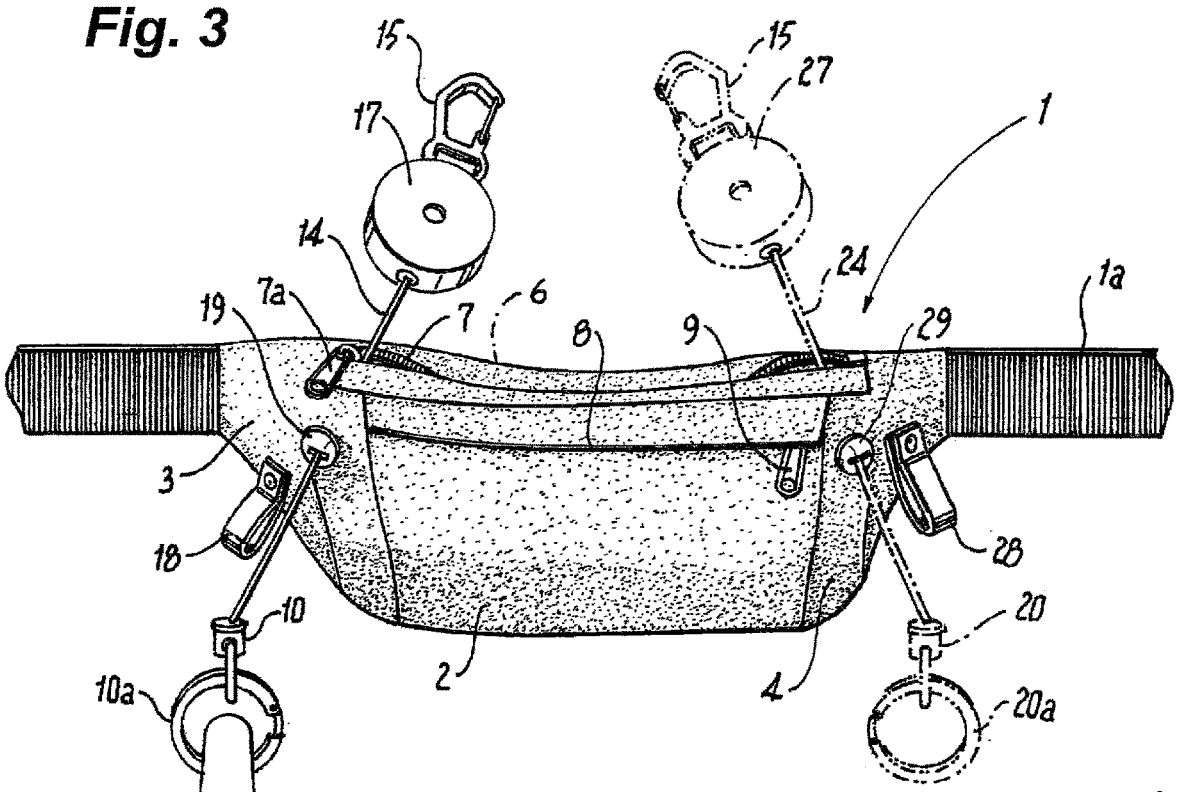
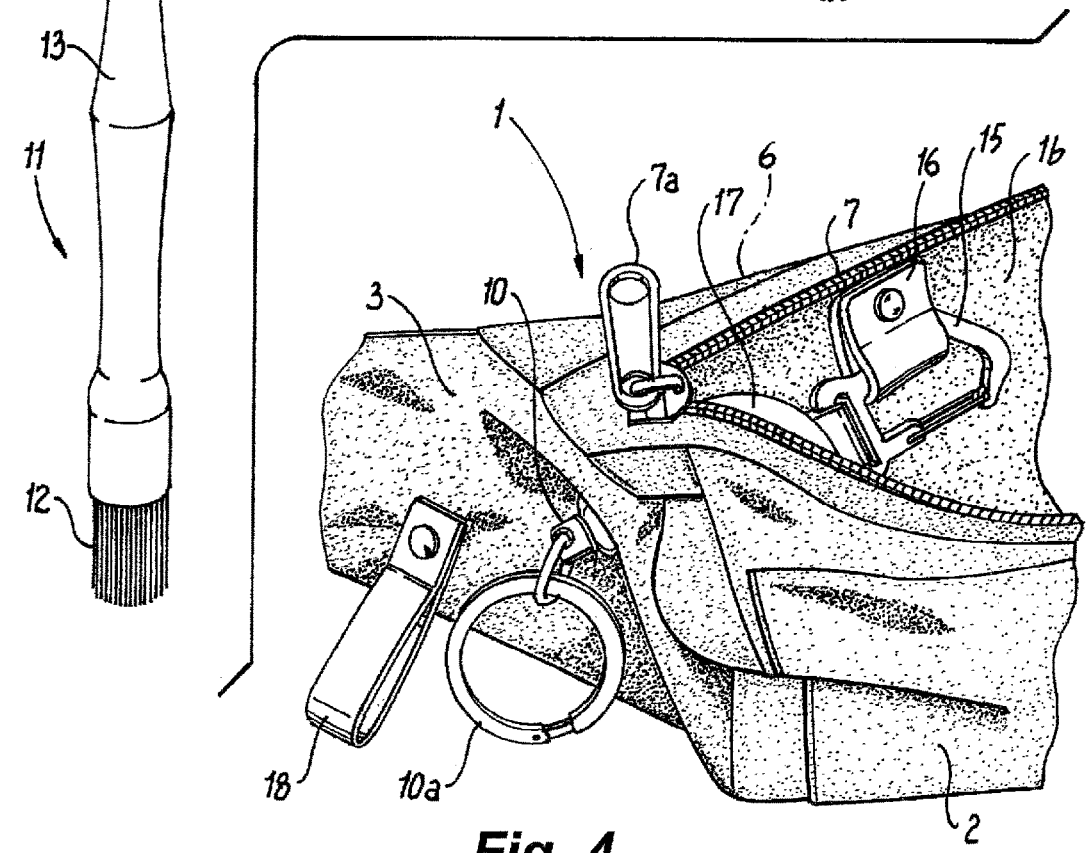
Fig. 4

Fig. 8
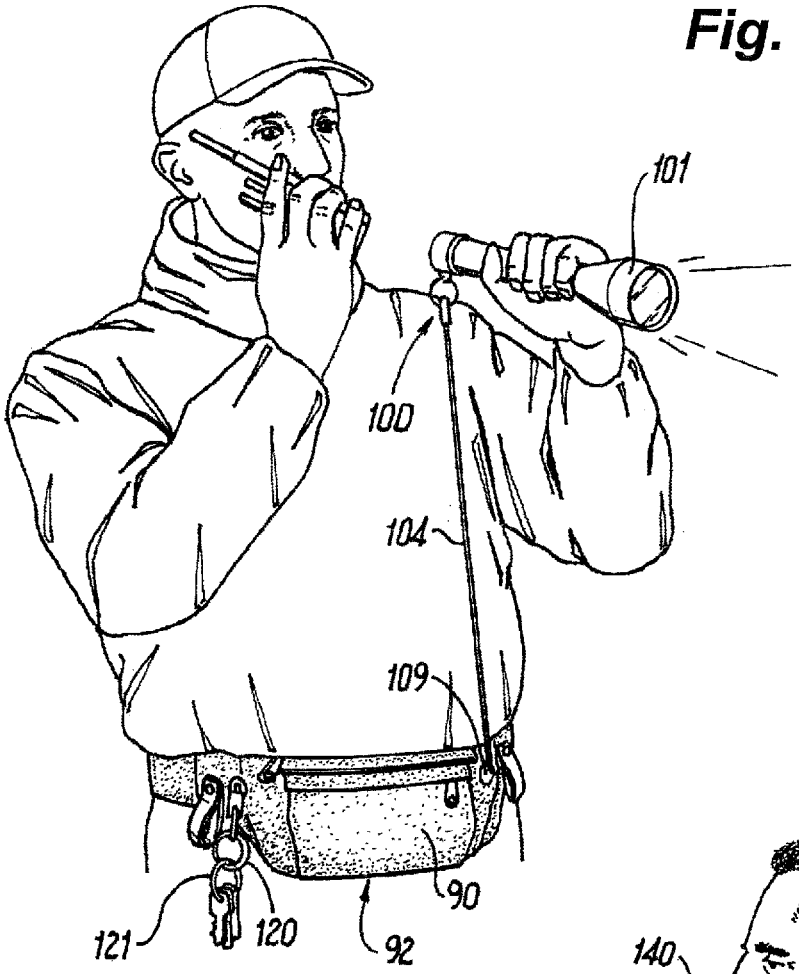
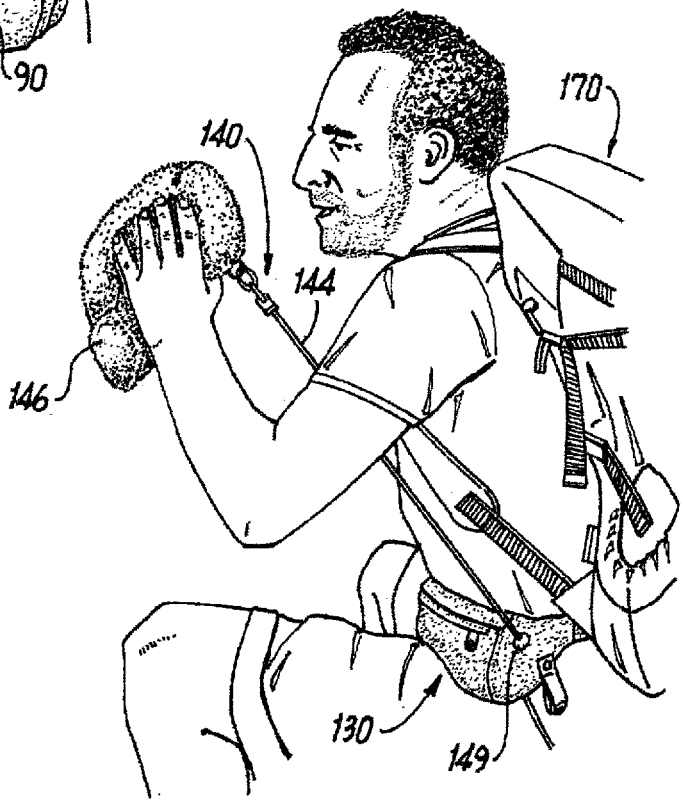
Fig. 9

VERSATILE AMBIDEXTROUS POUCH FOR ACCESSORIES FOR AUTOMOTIVE DETAILING AND OTHER INTERCHANGEABLE TOOL USES

FIELD OF THE INVENTION

The present invention relates to a versatile ambidextrous pouch worn on the user's front abdominal waist with a waist encircling belt, for quick and more efficient/ergonomic access to handheld accessories for automotive exterior and interior detailing, regardless of whether the user is right-handed or lefthanded.

BACKGROUND OF THE INVENTION

Detailing the exterior and particularly the interior of an automobile is a very labor intensive and painstaking process. Initially, it may entail the use of certain larger pieces of equipment, such as a steam cleaner and/or a vacuum cleaner (see e.g., "10 Must Have Interior Detailing Tools to Properly Clean Your Vehicle," available at detailexperts.net). However, professional automotive detailing also requires exacting use of multiple different sizes and types of detailing brushes (see FIG. 11), all of which tend to be elongated in shape, including, but not limited to, the following:

- Medium Duty Tire Brush—for scrubbing black wall tires, non-clear-coated wheels;
- Soft Grip Wheel Well Brush;
- Soft Flagged Bristle Brush—for dressing tires, cleaning wheels/interior components;
- Soft Grip Slot Wheel Brush—for cleaning between the slots and spokes of wheels;
- Brass Whitewall Brush—its stiff brass bristles more effectively remove dirt and curb scuff marks from white wall and white lettered tires;
- Carpet, Mat & Inner Fender Brush;
- Carpet & Upholstery Scrub Brush—for controlled cleaning of interior upholstered seats, carpet and door panels;
- Car Interior Utility Scrub Brush—a gentle multi-purpose brush for vehicles interiors;
- Large Cone Brush—for cleaning between wheel spokes and slotted front grill areas;
- Dashboard and Vent Brush—for air vents, radio buttons, knobs, instrument panels;
- Tooth Brush Styled Nylon Brush—for small inaccessible areas on carpet, upholstery and crevices.
- Step Panel and Mat Brush—for cleaning grooved step entry plates, pedals, mats and interior door panels;
- "Tooth" Brush—for cleaning and detailing the smallest areas;
- Horse Hair Detail Brush—for cleaning interior leather, vinyl, and plastic; and
- "Paint" Brush—for use on seat pleats, and console crevices.

Carrying cases/pouches for handheld tools exist, but are not particularly configured to house and provide efficient accessibility for the brushes and other tools of the trade required for automotive detailing, and also do not afford suitable ambidextrous accessibility for left-handed and right-handed users alike.

Pouches are designed for righthanded users, with frequently used features being located on the right side of the pouch's interior, so that the user can conveniently and quickly grab the tool, using his/her right hand. For right-handed people, the removal of the tool is pulled straight ahead by the user's right hand, generally directly perpendicular in line with the arm of the user, to the work surface.

However, when a left-handed person uses the aforementioned right-handed oriented tool pouch, the left-handed user has to reach awkwardly with the left hand and around the abdomen, to grasp the tool, pull it diagonally to the left, across the left-handed user's abdomen, and then, awkwardly advance it at an angle towards the work surface in line with the left side of the user's body.

Therefore, there is a need for an ambidextrous pouch that is furthermore particularly configured for quick access to handheld accessories, and includes more efficiently and ergonomically positioned tool/reel retraction at both the distal left side of the user's waist and the distal right side of the user's waist for the four most frequently used tools, for use in automotive interior and/or exterior detailing, regardless of whether the user is right-handed or left-handed.

Among related patents include U.S. Pat. No. 9,629,446 of Moreau, which describes a tool pouch with retractable cables for tethers with rings (loop connecters for tools). Due to the size of this pouch, it would be difficult to attach around the waist and perform auto detailing work. In contrast, the versatile ambidextrous tool pouch of the present invention is made for consistent wearing and be able to move quickly. Due to the size and bulk of the product it would also make it more prone to damages to the inside and outside of the vehicle.

The Kiceniuk U.S. Pat. No. 8,887,940 describes a versatile ambidextrous paint and tool bucket, which can be accessed by right- and left-handed people equally. After reviewing this product, it is designed for painting and similar trades. This product would make it difficult to use in the detailing industry. This product does not contain retractable tethers for quick and convenient use, without the worry of losing a tool. Due to the size and bulk of this product and no where's to attach to your body it would make it difficult to use and also create chances for damages.

The Barklow U.S. Pat. No. 11,253,049 describes a tool-carrying backpack with a retractable cable for attaching a tool. Pockets and fasteners are provided for tools. After reviewing this patent, this product would be too big and bulky for auto detailing. Being a backpack, it cannot be used to provide a tool without taking the backpack off of the user's back for use. In addition it cannot be worn in the front waist abdominal area of the user during simultaneous use of a tethered tool by the dominant left or right hand of the user. It also would make it very difficult to enter and exit a vehicle without creating damage. Also, it is prohibitive for fast paced movement. This product also offers way too much volume space in the bag which would not be needed for in the automotive detailing industry. This product is used for larger loads of equipment and for far distance carrying basically not ideal for the line or lines of work of which in contrast, the versatile ambidextrous tool pouch of the present invention is created for.

The Bocik U.S. Pat. No. 5,730,340 describes a fanny pouch for children's toys with retaining straps and fasteners. Although there are small compartments for storage, the retaining straps only allow for minimal distance. For detailing use the product would need at least an arm's length for use. Also, it would need a retractable tether that would give the user the ability to continue work without any interference. Additionally, a retractable cord such as in the present invention, would be not recommended for use around or by a child due to choking hazard or other dangerous situations. There is also no device attached to carry a spray or basic bottle in the toy pouch of Bosic.

The Hintze U.S. Pat. No. 10,736,406 describes a small belt-worn tool retaining device, which holds a tape measure tool by means of a retractable cord which holds the tape measure in elongated positions. Although this product does have a retractable tether it would not be able to be attached to a thin handle brush, also does not have the capability to carry several brushes. This product also does not have any compartments for storage for other material. Also note that this product does have a locking mechanism which is not ideal for auto detailing. In contrast, the present invention is made to freely grab the user's tool and pull for quick use by a dominant left or right hand of the user.

The Moreau U.S. Pat. No. 10,442,075 describes a tool pouch with internal pockets and fasteners for tools. This patent is made to be worn around the shoulders on a person back, which would make it very difficult in the detailing industry. This could possibly cause damage to the seats and other parts of a vehicle. This would also make it very difficult for quick access to their tools while cleaning. This patent also does not have retractable tethers which would make it more difficult during use for detailers. By having retractable tethers, it's more accessible for the user's tools and quick easy clearance to continue the user's work. In contrast, the versatile ambidextrous tool pouch of the present invention also is designed for constant wear, and therefore would be of no use as a stationary pouch not worn on the body.

U.S. Pat. No. 10,897,943 of Pagano describes a shoulder worn accessory bag with mini compartments on the shoulder strap. The Pagano bag is described as ambidextrous in that it can be used over the right or left shoulder of the user, but does not indicate an appropriate use of any tool in a pouch worn on the front waist of the user so that a left handed person has equal access to a selected primary tool on the left side of the pouch as does a right handed person having access to a selected primary tool on the right side of the pouch.

U.S. Reissue Pat. No. RE47,263 E of Hendrickson describes a pouch with a belt clip generally worn in the left or right hip area of the user. The pouch has an upper compartment for carrying personal items such as a cell phone, driver's license and credit cards, and a lower openable compartment for dispensing a flexible coil downward for attaching a wristband to a child, for the purpose of tethering the child to the adult caregiver wearing the pouch.

U.S. Pat. No. 11,026,501 of Dabrowka describes a backpack with a removable personal safety ballistic shield for protecting the front of the body from harm due to bullets, or other lethal or harmful projectiles with the storage of the shield on the back of the user. The backpack is ambidextrous because it allows a left handed or right handed person to access the ripcord release from over either shoulder. However it is not designed for use of tools that are accessible from the user's waist area, as in the present invention.

US Patent Publication 2009/0159365 A1 of O'Brien describes a backpack and firefighter's harness unit for the purpose of providing oxygen from a tank attached on the back of the user with this invention. The wearer uses both hands to don and doff it. It also has a body harness for use as a saddle for allow for the transport of the user by other firefighters. However it does not describe a waistbelt worn accessory tool pouch as in the present invention where the use selects a primary tool on the dominant hand side while still having access to a secondary tool on the less dominant hand, and where each primary tool is connected by a retractable cord to allow straightforward access of the primary tool by the user's dominant hand, and without having to access a primary tool from the opposite side of the user's abdomen and then awkwardly having to cross the abdomen for angular use by the dominant hand.

US Patent Publication 2009/0242598 A1 of Dormaar describes a conical holster for holding a conical shaped tool with a downward dispensing or work surface distal end from the chest of the user. Because the single tool droops downward from the chest of the user, it can be manipulated by either the left hand or the right hand of the user and with accessory options to hold other tools while the user's hands are left free during use of the holster. However it does not describe a waistbelt worn accessory tool pouch as in the present invention where the use selects a primary tool on the dominant hand side while still having access to a secondary tool on the less dominant hand, and where each primary tool is connected by a retractable cord to allow straightforward access of the primary tool by the user's dominant hand, and without having to access a primary tool from the opposite side of the user's abdomen and then awkwardly having to cross the abdomen for angular use by the dominant hand.

US Patent Publication 2016/0010948 A1 of Gerdes describes specifically a concealed carry purse with ambidextrous access to a firearm in it's pouch on the left or right side of the firearm compartment of the purse. However it does not describe a waistbelt worn accessory tool pouch as in the present invention where the use selects a primary tool on the dominant hand side while still having access to a secondary tool on the less dominant hand, and where each primary tool is connected by a retractable cord to allow straightforward access of the primary tool by the user's dominant hand, and without having to access a primary tool from the opposite side of the user's abdomen and then awkwardly having to cross the abdomen for angular use by the dominant hand.

Thus, the aforementioned US patents describe pouches for tools in general, that are not suitable for both right-handed and left-handed workers, due to their lack of dexterity depending upon which hand the user is dominant with.

Therefore, the use of a versatile ambidextrous accessory tool pouch, as in Applicant's present invention, in conjunction with its interchangeability for tool location and access, is not only not suggested, but would be discouraged or taught away by the references relied on.

OBJECTS OF THE INVENTION

It is therefore an object of the present invention to provide a versatile ambidextrous pouch for accessories for automotive detailing and other interchangeable tool uses.

It is also an object of the present invention to provide versatile ambidextrous pouch for accessories for automotive detailing and other interchangeable tool uses, which utilizes a user selected primary tool and a secondary tool for right-handed workers, and which utilizes a user selected primary tool and a secondary tool as selected by left-handed workers.

It is also an object to provide a tool pouch which enables both right-handed workers and left-handed workers to choose a primary frequently used tool for the dominant hand of the worker and a secondary less used tool for the less dominant hand interchangeably.

It is also an object to provide straightforward access of a tethered tool to a work surface by the dominant hand of a user, without the user having to reach across the users abdomen, grasp the tool with the dominant hand and to awkwardly pull the tool angularly across the abdomen to reach a working surface.

Other objects which become apparent from the following description of the present invention.

SUMMARY OF THE INVENTION

In keeping with these objects and others which may become apparent, the present invention is a versatile ambidextrous waist belt worn pouch which provides quick access to handheld accessories for automotive detailing and other interchangeable tool uses, regardless of whether the user is right-handed or left-handed.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The versatile ambidextrous accessory waist belt worn tool pouch of the present invention enhances the tool use by incorporating separate eyelets and retractable cables on both sides of the pouch, which is worn in the front abdomen of the user, at the waist, so that the user can choose to have the most frequently used tool to be on the side of the body closest to the dominant hand of the user, with less frequently used tools on the opposite side away from the dominant hand of the user. The addition of opposite side access holes and retractable cords prevents loss of tools and enables the user to choose the most frequently used tool to be placed on either side of the pouch depending upon the location of the user's dominant hand, which greatly enhances ease of using the tools without losing the tool, while maintaining the versatile ambidextrous pouch for accessory tools' utility as a storage for accessory hand tools.

The pouch of the present invention is a versatile, interchangeable ambidextrous waist belt worn carry pouch for tools, where optional internal or external pockets are provided for storing handheld tools. Additionally, a pair of retractable cables, each with a reel, have been provided on each side of the pouch so that both right-handed users and left-handed users can select a preferred primary tool on the side of the pouch located in front of the user's waist nearest the user's dominant hand (right- or left-handed). The selected side of the pouch allows for short, direct use straight ahead, without having to pull the tool across the abdomen and then awkwardly forward at an angle, for use on the wrong side of the user's body. The pouch allows a user to manually grasp a tool with the user's dominant hand, whether right-handed or left-handed, and to extend the selected dominant hand tool via a retractable cable, so that the user can extend the tool to the working surface, use the tool, and then have the tool retract back to an outside surface of the pouch, when the reel causes the cable attached to the tool to wind around the spindle of the reel.

For pouches which are designed for righthanded users, the reel is located on the right side of the pouch's interior, so that the user can conveniently and quickly grab the tool, such as a brush and handle used in auto detailing of an interior upholstery of an automobile. For righthanded people, the retractable tool is pulled straight ahead by the user's right hand, directly perpendicular in line with the arm of the user to the work surface.

For a left-handed, the user selects the dominant left-handed tool and pulls it straightforward and outward, from the left side of the pouch, with a retractable cable for the tool, such as a brush for cleaning automobile upholstery, thereby avoiding the left-handed user having to reach awkwardly with the left hand and around the abdomen to grasp a tool from the right side of the pouch and without, pulling it diagonally to the left, across the left-handed user's abdomen, and without awkwardly advancing the tool towards the work surface and not in line with the left side of the user's body.

Besides use in the automotive detailing industry, the ambidextrous pouch can be used in other occupational service industries, such as pet grooming, beauty and makeup services, search and rescue services, or in recreational services, such as for athletes or outdoors hikers.

Therefore, the versatile ambidextrous pouch provides quick access to handheld accessories for automotive detailing and other interchangeable tool uses, regardless of whether the user is right-handed or left-handed.

The versatile ambidextrous waist belt worn tool pouch of the present invention is also made for consistent wearing in front of the user's waist, and to be able to move quickly without losing unattached tools.

The versatile ambidextrous waist belt worn waist belt worn tool pouch can be accessed by right- and left-handed people equally and it includes retractable cables, which act as tethers for user selected primary and secondary tools, for quick and convenient use, without the worry of losing a tool, and where the pouch can be worn ergonomically.

The versatile ambidextrous hand tool pouch has the capability to carry several brushes, including a frequently used primary tool located near the dominant hand of the user and a secondary, less used tool located across the body from the dominant hand. This pouch also includes compartments for storage for other tools and material, and an optional locking mechanism for the accessory tool pouch, so that the user can freely grab a tool and pull for quick use.

By having retractable cable tethers, it is more accessible for accessing hand operable tools and with quick easy clearance to continue work. The versatile ambidextrous tool pouch of the present invention also is designed for constant resistance to wear and tear.

In summary, the versatile ambidextrous pouch conveniently carries at the user's front waist tool accessories used in automotive detailing or other service industries, as well as for recreational pursuits.

The versatile ambidextrous waist belt worn pouch includes a pouch containing handheld accessories for automotive detailing and other interchangeable tool uses wherein the pouch comprises one or more interior pockets formed by multiple walls extending along a length of the pouch, and end walls enclosing the pockets.

One or more closable fastener openings are provided for gaining access to tools in the aforesaid pockets, and a waist belt extends from opposite right and left top ends of the pouch adapted to be worn by a user. The closable fasteners for the openings can be zippers, hook and loop fasteners, snap fasteners, buttons, ZIPLOC® fasteners, and other fasteners know to those skilled in the art of tool pouches.

Adjacent each side end of the pouch is provided an eyelet for a retractable cable, wherein a distal end of each retractable cable has a cable fastener adapted for carrying one or more of frequently used tools for detailing within the vehicle (or for other service industries or recreational uses), and a housing for each retractable cable being attached to the pouch in a pocket thereof.

The frequently used tools are being mounted on the cable fastener selected by the user to correspond to a side of the pouch associated with the dominant hand of the user for quick access to the frequently used tools, in the vicinity of the central front portion of the user's abdominal waist.

One of said frequently used tools is at least one brush, in an environment in which the frequently used tools include primary and secondary cleaning or application brushes.

The pouch includes multiple eyelets, retractable cables and cable fasteners adjacent to each end of the pouch on the right and left sides of the front of the pouch, wherein the cable fasteners may include loops.

Inside the pouch, a housing for each retractable cable is attached to a carabiner fastener within a pocket of the pouch.

The pouch may optionally have auxiliary loop fasteners at each end of the outside of the pouch, suspend other tools or liquid filled cleaning containers.

The present invention also describes a method of carrying and using handheld accessories for automotive detailing and other service-related industries or recreational uses.

In use, a user attaches the pouch to his/her front waist, via the waist belt, mounted on a waist belt. The pouch contains handheld accessories for automotive detailing and other interchangeable tool uses. The pouch includes one or more pockets formed by multiple walls, extending along a length of the pouch, where the pouch's end walls enclose the pockets, and one or more openings with a mechanical structure for gaining access to tools within the pockets, e.g., a zipper or zippers, hook and loop fasteners, snap fasteners, buttons, ZIPLOC® fasteners, etc.

Provided adjacent each side end of the pouch are respective opposite eyelets for a retractable cable to extend through the pouch on left and right sides thereof.

A housing is provided for each retractable cable within a pocket of the pouch, wherein a distal end of each retractable cable passes through one of the eyelets. Each cable has a cable fastener at a distal end of the cable, adapted for carrying one or more of frequently used tools for detailing within the vehicle being cleaned, or for other service or recreational uses.

The most frequently used tools are mounted on the cable fastener selected by the user, to correspond to a side of the pouch associated with the dominant hand of the user for quick access to said frequently used tools; which enables the user to extend an arm carrying the dominant hand to reach one of the frequently used tools located on the same side of the waist belt worn pouch, corresponding to the dominant hand for carrying out detail work within said vehicle, irrespective of the user being right-handed or left-handed.

For example, one of the frequently used tools is a brush, selected from a set of frequently used tools, including primary and secondary cleaning brushes.

The cable fasteners holding the tools can include loops. Each housing for each retractable cable is attached preferably to an internally-mounted fastener in the pouch, such as a carabiner fastener. The exterior tool fastener can have auxiliary loop fasteners at each end of the pouch. Moreover, the waist belt extends from opposite right and left top ends of the pouch for wear.

Besides holding tools for vehicle detailing, the pouch can hold pet grooming brushes and other tools, beauty parlor tools, including make-up brushes or other tools, or rescue tools, including flashlights or door-opening keys. For house cleaners, tools can include window treatment dusters, all-purpose dusters, cleaning rags, keys, and spray cleaners. For the recreational user, the pouch can hold fabric sweat towels or other accessories.

BRIEF DESCRIPTION OF THE DRAWINGS

The present invention can best be understood in connection with the accompanying drawings. It is noted that the invention is not limited to the precise embodiments shown in the following drawings. In the description of the drawings, the word "right side" and "left side" refer to what the user would see when wearing the pouch. Therefore, with the user depicted in the drawings facing forward, the right side of the pouch is shown on the left side of the drawings, and the left side of the pouch is shown on the right side of the drawings.

FIG. 3 is a close-up detail front view of the versatile ambidextrous waist belt wom tool accessory pouch, showing a brush on the right side of the pouch (when viewed from the rear) of the present invention; and wherein a holding loop fastener for a left-handed person, is shown in phantom dashed lines, revealing the alternate storage position for a brush to be used by a left-handed user.

FIG. 4 is a close up detail perspective view of an open right side corner of the versatile ambidextrous waist belt worn tool accessory pouch, revealing an open zipper closure in an open position and further revealing an interior sewn carabiner clasp for the retractable cable attached to an exterior loop fastener for a tool, such as an auto detailing brush, located on the right side of the pouch, together with a second sewn in loop for exterior attachment of another tool on the right side of the versatile ambidextrous tool accessory pouch (when viewed from the rear).

FIG. 8 is a perspective view of an alternate embodiment for use of the versatile ambidextrous tool accessory pouch in a search and rescue night environment.

FIG. 9 is a perspective view of an alternate embodiment for use of the versatile ambidextrous tool accessory pouch in a remote hiking environment.

LIST OF REFERENCE NUMERALS

Figure 1:
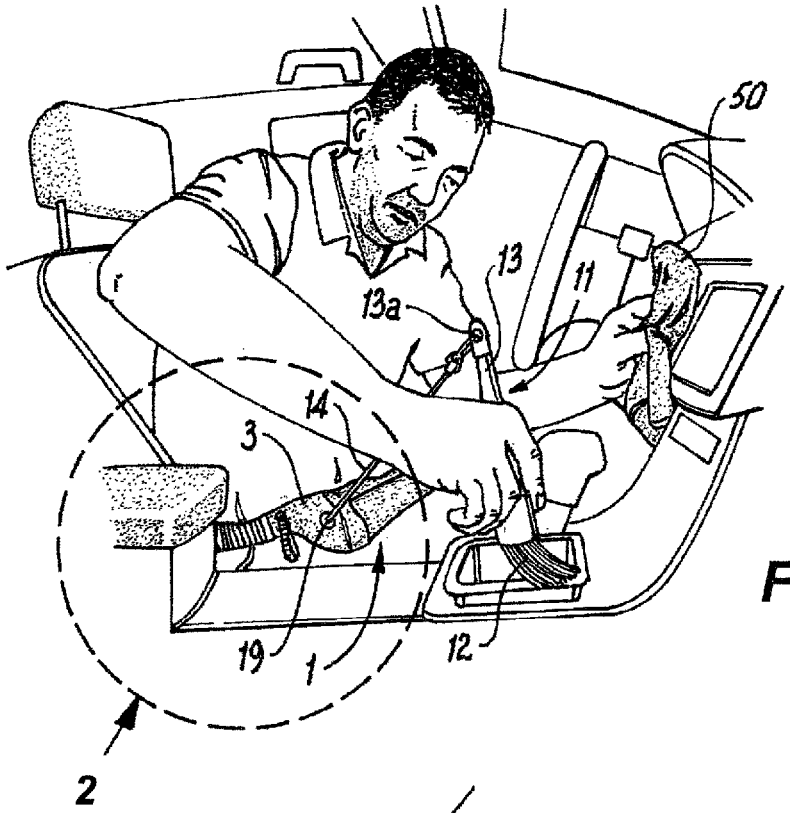
FIG. 1 is a perspective view of the versatile ambidextrous tool accessory waist belt worn pouch, shown in use by an auto detailer using a tethered handled brush, which is retractable back to the exterior surface of the pouch by a retractable cable.

1. Versatile ambidextrous waist belt worn tool accessory pouch
1*a* Waist belt for pouch
1*b* Interior wall of pouch
2. Front panel of pouch
3. Right side panel of pouch
4. Left side panel of pouch
5. Top panel of pouch
6. Rear panel of pouch
7. Top zippers of top openable pouch
7*a* Top zippers pull handle of top openable pouch
8. Front zippers of secondary front openable pouch
9. Front zippers pull handle of secondary front openable pouch
10. Right side cable fastener for tool
10*a* Loop fastener for cable fastener 10
11. Right side primary cleaning brush tool
12. Right side cleaning brush bristles
13. Right side cleaning brush tool handle
13*a* Fastener hole in handle of brush
14. Right side retractable cable
15. Carabiner fastener for right side retractable cable
16. Wall attached loop for carabiner fastener
17. Right side mechanical housing for retractable cable 14
18. Right side exterior auxiliary tool loop fastener
19. Right side eyelet hole in pouch for right side retractable cable 14
20. Left side eyelet hole in pouch for left side retractable cable 24
20*a* Loop fastener for left side cable fastener 20
21. Left side secondary cleaning brush tool
22. Left side cleaning brush bristles
23. Left side cleaning brush tool handle with fastener hole 23*a*
24. Left side retractable cable
25. Left side carabiner fastener for retractable cable housing 27
27. Left side mechanical housing for retractable cable 24
28. Left side exterior auxiliary tool loop fastener
29. Left side eyelet hole in pouch for right side retractable cable 24
31. Left side primary cleaning brush tool
32. Right side secondary brush tool with cleaning brush bristles
33. Left side rush handle with fastener hole 33*a*
33*a* Fastener hole for left side rush handle 33
41. Right side secondary cleaning brush tool
42. Right side secondary brush bristles
43. Right side brush handle with fastener hole 43*a*
50. Auxiliary wiping cloth
60. Tool pouch for dog groomer
62. Front panel of tool pouch for dog groomer
71. Right side hair/fur cutter
74. Retractable cable
79. Fastener for hair/fur cutter
80. Fastener for cosmetic tool
81. Cosmetic tool brush
83. Secondary tool for cosmetician
84. Retractable cable for cosmetic tool brush
89. Eyelet hole for retractable cable 84
90. Versatile ambidextrous pouch for rescue worker
92. Front panel of pouch 90
100. Loop fastener for tool flashlight 101
101. Flashlight
104. Retractable cable for tool flashlight 101
109. Eyelet hole in pouch 90 for retractable cable 104
120. Loop fastener for secondary tool key set 121
121. Secondary tool key set
130. Versatile ambidextrous pouch for wilderness hiker
140. Fastener for fabric wiping cloth
141. Fabric wiping cloth
144. Retractable cable for wiping cloth 141
170. Auxiliary backpack
180. Ambidextrous tool accessory pouch for a house cleaning worker
181. Primary tool all-purpose duster for window treatment 200
184. Retractable cable 184 for primary tool all-purpose duster 181 for window treatment 200
191. Secondary less frequently used cleaning rag 191
194. Retractable cable 194 for cleaning rag 191 on the secondary, non-hand dominant side of the pouch 180
196. Optional bottle of spray cleaning fluid with a small collar 197 around the neck of the bottle
197. small collar around the neck of spray bottle 196
198. Exterior loop 198 on one side of the pouch 180 for suspending cleaning fluid bottle 196.
200. residential window treatment being cleaned by cleaning worker

DETAILED DESCRIPTION OF THE INVENTION

The present invention has broad applications to many technical fields for a variety of articles (see e.g., FIGS. 6-10). However, it is particularly adapted for use by a professional automobile detailer while detailing a vehicle (see FIGS. 1-5), and for illustrative purposes only, that preferred mode for carrying out the invention is described herein, wherein a versatile ambidextrous waist belt worn tool accessory pouch utilizes mirror image placement of fasteners therein, so that a left-handed user would have the same access to a primary tool as would a right-handed user.

As used throughout this specification, the word "may" is used in a permissive sense (i.e., meaning having the potential to, or being optional), rather than a mandatory sense (i.e., meaning must), as more than one embodiment of the invention may be disclosed herein. Similarly, the words "include", "including", and "includes" mean including but not limited to.

The phrases "at least one", "one or more", and "and/or" may be open-ended expressions that are both conjunctive and disjunctive in operation. For example, each of the expressions "at least one of A, B and C", "one or more of A, B, and C", and "A, B, and/or C" herein means all of the following possible combinations: A alone; or B alone; or C alone; or A and B together; or A and C together; or B and C together; or A, B and C together.

Also, the disclosures of all patents, published patent applications, and non-patent literature cited within this document are incorporated herein in their entirety by reference. However, It is noted that the citing of any reference within this disclosure, i.e., any patents, published patent applications, and non-patent literature, is not an admission regarding a determination as to its availability as prior art with respect to the herein disclosed and claimed apparatus/method.

Furthermore, any reference made throughout this specification to "one embodiment" or "an embodiment" means that a particular feature or characteristic described in connection therewith is included in at least that one particular embodiment. Thus, the appearances of the phrases "in one embodiment" or "in an embodiment" in various places throughout this specification are not necessarily all referring to the same embodiment. Therefore, the described features, advantages, and characteristics of any particular aspect of an embodiment disclosed herein may be combined in any suitable manner with any of the other embodiments disclosed herein.

Figure 2:
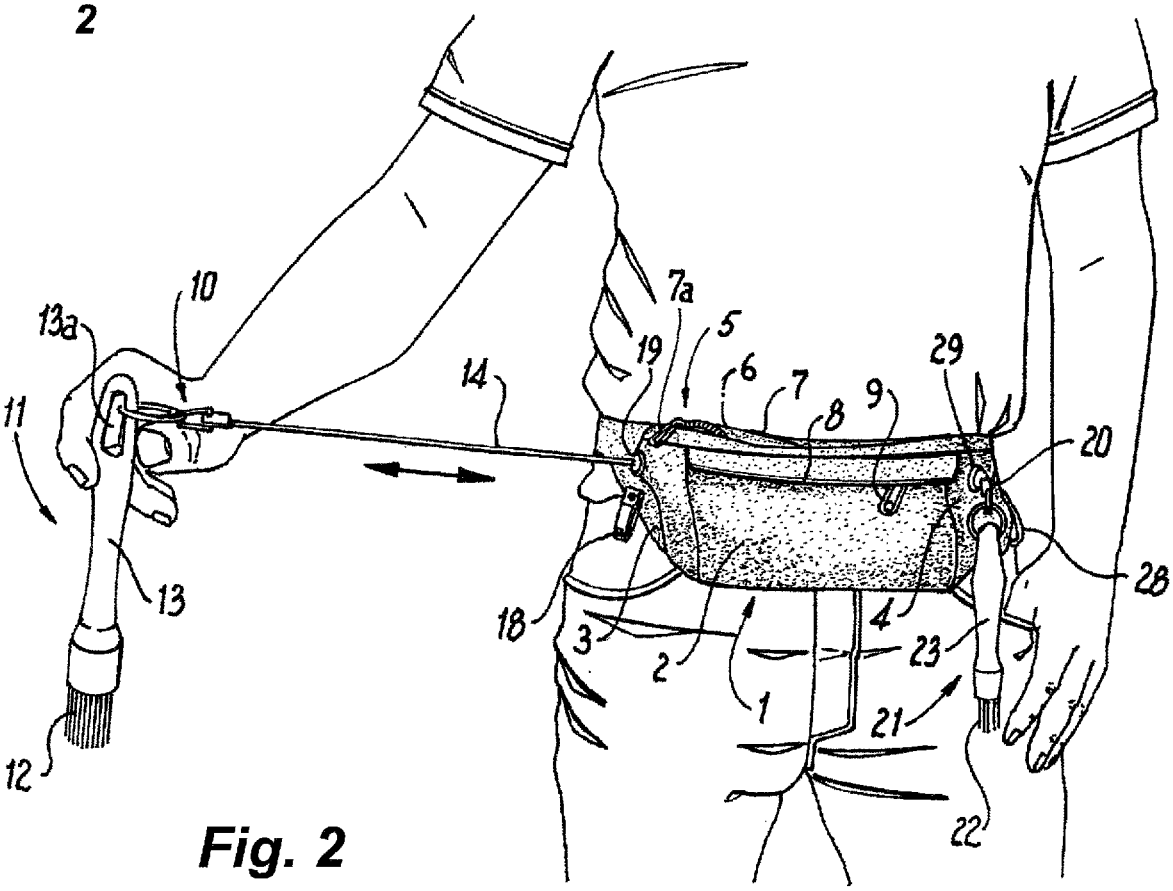
FIG. 2 is a front perspective view of the versatile ambidextrous tool accessory waist belt worn pouch, of the present invention, as in FIG. 1, showing a user extending the brush and retractable cable outward where the user's right hand is holding the brush.

FIG. 1 is a perspective view of the versatile ambidextrous tool accessory pouch 1 shown in use worn in front of the abdominal waist of a user, by a right-handed user, having internal fasteners for retractable cable mechanisms 14, which extend through eyelet 19 on one side of the front of the pouch 1, which is, shown in use by an auto detailer using a tethered handled brush with a handle 13, which is retractable back to the interior surface of the pouch 1 by a retractable cable 14. The eyelets may be positioned on the pouch so as to be proximate to the distal left side and distal right side of the wearer's waist, with the eyelets spaced apart at least FIG. 2 is a front perspective view of the versatile ambidextrous tool accessory pouch 1, of the present invention. Pouch 1 is shown with front panel 2, opposite side panels 3 and 4, top panel 5, having zippers 7 and zipper pull 7*a*, and rear panel 6. As seen in FIG. 2 (as well as the pouch shown in FIG. 8), a zipper 7 may be positioned to extend substantially linearly across a top surface of the elongated pouch.

As also disclosed in FIG. 2, a right-handed user grasps and extends the right-handed brush 11 and retractable cable 14 outward where the user's right hand is holding the right-handed brush 11 with handle 13, and which has distal bristles 12 and a fastener hole 13*a* for attachment by fastener 10 attached to retractable cable 14, inside a housing 17. The cable 14 extends through right sided eyelet 19 of pouch 1. Pouch 1 is also shown with front panel 2, opposite side panels 3 and 4, top panel 5 having zippers 7 and zipper pull 7*a*. As may be seen in FIG. 4, an internally sewn or adhesively attached loop fastener 16 of internal surface 1b of pouch 1 holds right side carabiner fastener 15. Also, as may be seen in FIG. 3 and FIG. 4, a second end of the cable 14 that is coupled to the reel 17 with carabiner 15 may form a third cable and reel arrangement, with the cable 14 being configured to extend out from within the interior compartment of the pouch at a distal left side of said pouch, and which arrangement, as seen in comparing FIG. 3 and FIG. 4, permits this reel of the third cable and reel arrangement to be positioned either inside or outside of the interior compartment of the pouch 1. Similarly, a second end of a cable 24 that is coupled to the reel 27 with carabiner 15 may form a fourth cable and reel arrangement, with the first end of the cable 24 being configured to extend out from within the interior compartment of the pouch at a distal right side of the pouch, and which arrangement, as seen in comparing FIG. 3 and FIG. 4, also permits this reel of the fourth cable and reel arrangement to be positioned either inside or outside of the interior compartment of the pouch 1. As shown in FIG. 3, a carabiner 15 is coupled to, and extends away from the reel 17 on the left side, and another carabiner 15 is coupled to and extends away from the reel 27 on the right side, where each respective cable 14, 24 extends out from the corresponding reel 17, 27, and is retractable within the respective reel, and each cable extends from outside of the pouch compartment and passes through the opening formed when the linearly oriented zipper is unzipped, into the compartment, and then out of the pouch through the respective eyelet 19, 29, after which it is coupled to the respective carabiner 10*a*, 20*a* using the respective fasteners 10, 20. Therefore, the ambidextrous tool accessory pouch 1 is particularly configured to hold four of the most often used car detailing brushes (see FIG. 11) in a readily accessible and ergonomic positions on retractable cables, with two being disposed on the distal left side of the pouch and two disposed on the distal right side of the pouch, being spaced apart at least 80 percent of one-half of the circumference of the user's waist (i.e., 40 percent of the user's waist), and more preferably across at least 90 percent of one-half of the circumference of the user's waist in another embodiment (i.e., 45 percent of the user's waist), and may be positioned proximate to where the user's pants pockets would be located. As may be understood from FIG. 3, each carabiner fastener 15 is capable of attachment to a tool the same as is shown therein for the attachment of brush 11 to carabiner fastener 10*a*, and a person of ordinary skill in the art would recognize this capability of the carabiner fastener 15.

As shown in FIGS. 2 and 3, optional further sewn-in or otherwise attached exterior loops 18, 28 can be provided for holding other externally accessible tools or containers, such as fluid cleaning or first aid containers (not shown), with removable caps or spray nozzles, and without retractable tether cables.

Figure 5:
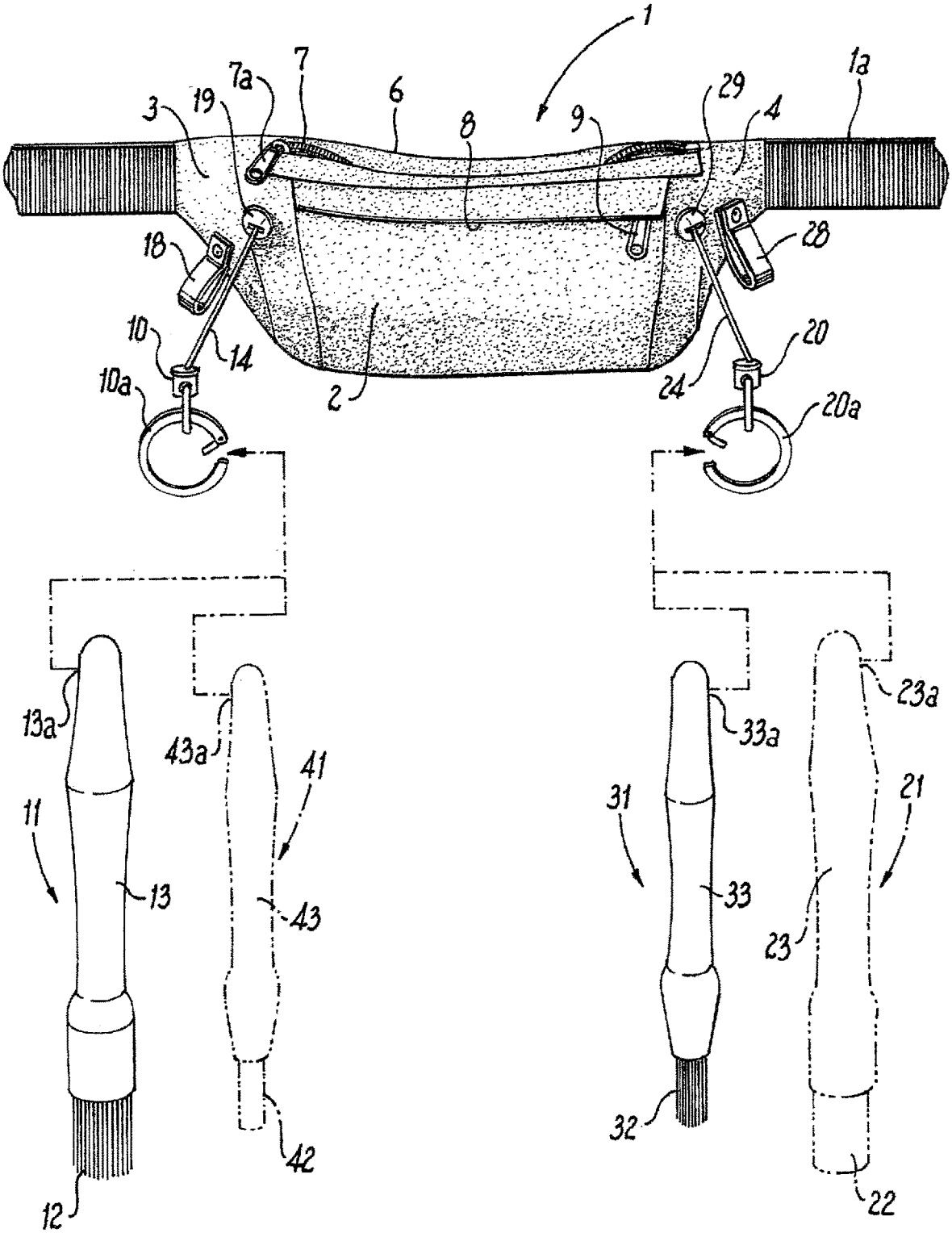
FIG. 5 is a front elevation view of the versatile ambidextrous waist belt worn tool accessory pouch, showing both left-handed and right-handed accessible loop clasps and retractable cables for a primary brush on the right side and a secondary less used brush on the left side for a right-handed person, wherein a primary brush and secondary less used brush for a left-handed user is shown in phantom dashed lines of the present invention.

FIGS. 2, 3, 4 and 5 also show the versatile ambidextrous waist belt worn tool accessory pouch 1, of the present invention, as in FIG. 1, but also, as shown in FIGS. 3 and 5, in dashed phantom lines, for a left-handed person, including extending the left-handed brush 21 and retractable cable 24 with housing 27, as shown in FIG. 5, where the cable 24 extends outward, when the user's left hand would hold the selected primary left-handed brush 21 with handle 23. Left-handed selected primary brush 21 has distal bristles 22 and a fastener hole 23*a* for attachment by fastener 20 attached to retractable cable 24, which extends through left-sided eyelet 29 of pouch 1. An internal sewn or adhesively attached loop fastener (not shown) of internal surface 1*b* of pouch 1 holds carabiner fastener 28 attached to housing 27 with retractable cable 24, having distal fastener 20 with openable loop fastener 20*a*. As may be seen in FIG. 2 and FIG. 3, the ambidextrous tool accessory pouch 1 may be particularly configured in one embodiment to extend laterally across a substantial majority of the user's front waist portion (e.g., to extend across at least 80 percent of one-half of the circumference of the user's waist, and more preferably across at least 90 percent of one-half of the circumference of the user's waist in another embodiment, and most preferably across at least 95 percent of one-half of the circumference of the user's waist in yet a different embodiment), when supported by a waist belt configured to be worn around the waist of the user, and to position the pouch at a front central abdominal waist region of the user. This configuration thereby positions four of the most often used car detailing brushes (see e.g., FIG. 2) in readily accessible and ergonomic positions on retractable cables proximate to the user's sides/arms, with two being disposed on the distal left side of the user's waist and two being disposed on the distal right side of the user's waist. In addition to this length requirement for the ambidextrous tool accessory pouch 1, it is also configured to have a shallow height, being, as seen in FIG. 2, such that its length is about 2 and % half times longer than it is tall. This length and height is also particularly configured to hold the assortment of other brushes utilized by the auto detailer, (i.e., the brushes shown in FIG. 11, other than the four most frequently used brushes that may be coupled to the retractable cables), but to not be so deep as to encumber visible sighing of, and accessing and removing of, one of those other brushes from the interior of the pouch when needed by the auto detailer. The ambidextrous tool accessory pouch 1 may be formed to have a top surface, a bottom surface, a front surface, a rear surface, a left side surface, which may be angled, and a right side surface, which may also be angled. In one embodiment, all of the features of the ambidextrous tool accessory pouch 1 are symmetrically positioned.

FIG. 5 also shows where the right-handed user can choose brush 11 as the primary tool to extend directly outward from the user's front waist, and a less used smaller secondary brush 31, having bristles 32, handle 33 and fastener hole 33*a*. FIG. 5 also shows in dashed phantom lines, the left-handed user having optionally brush 21 as the primary brush, and the smaller, less used brush 41 as the secondary brush with brushes 42, handle 43 and handle hole 43*a*.

FIG. 5 indicates that a right-handed user could optionally have the lesser used secondary brush 31 temporarily on the left side and a left-handed user can have a lesser used secondary brush 41 on the right side. Instead of brushes, the user could select any tool as a primary tool on the dominant hand side, or any other tool on the opposite non-dominant side of the pouch.

While FIG. 5, shows brush tools 11 and 31 associated with right-handed users and brush tools 21 and 41 for left-handed users, the pouch could optionally be provided with more than two cables 14 and 24, for example, two more cables and reels with carabiner fasteners (not shown), so that brush tools 11, 31, 21 and 41 could each be provided with retractable cables and reels the ambidextrous pouch 1.

In yet another embodiment four or more cables and reels with carabiner fasteners (not shown) could be provided with the pouch 1, so that a user (either left handed or right handed) could have four or more selected tools being provided with the pouch 1.

Figure 11:
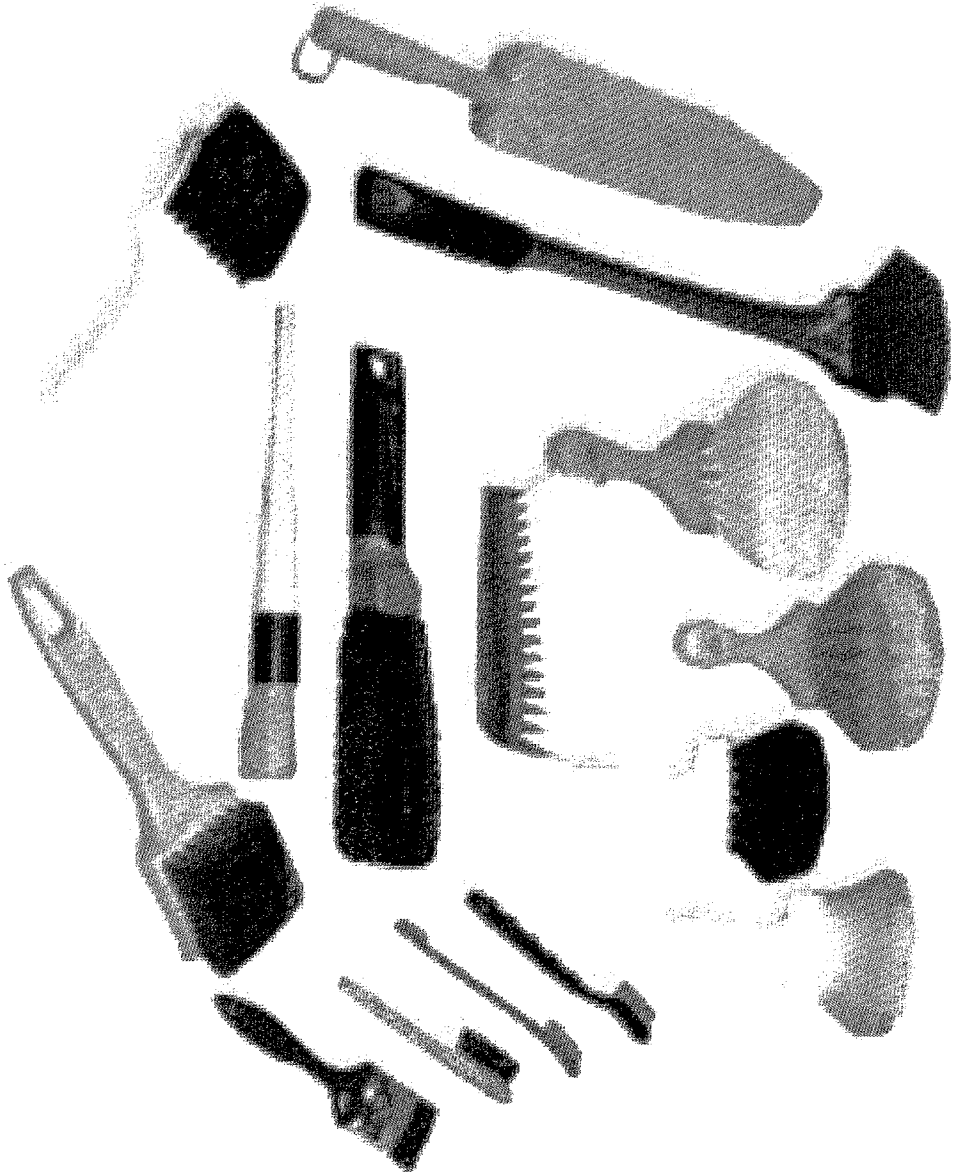
FIG. 11 is an exploded view showing an array of different automotive detailing brushes that may be used by a professional auto detailer while detailing a client's vehicle.

FIG. 11 shows an array of different automotive detailing brushes that may be used by a professional auto detailer while detailing a client's vehicle, as shown in FIGS. 1-5.

Figure 6:
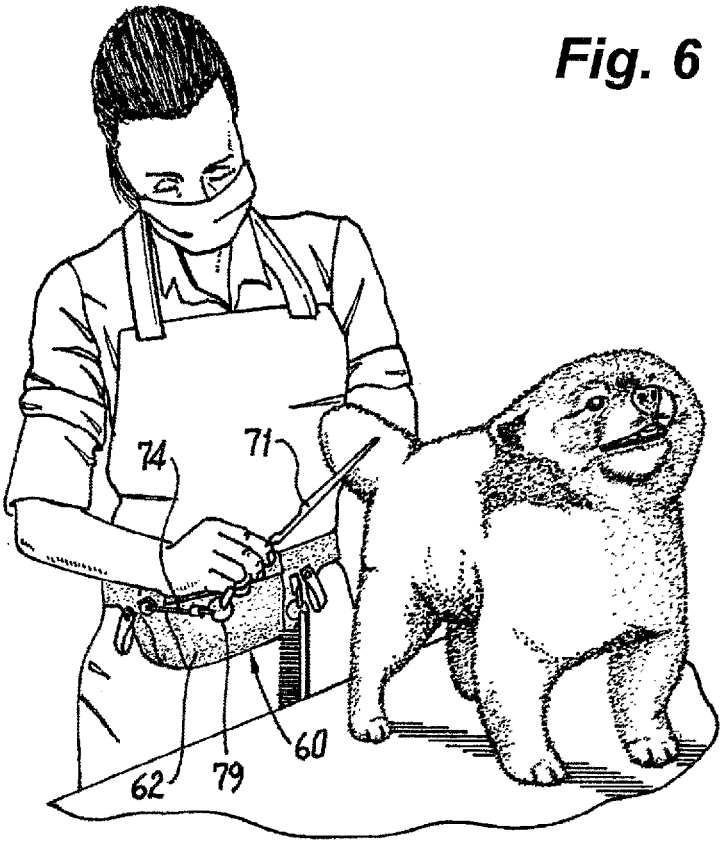
FIG. 6 is a perspective view of an alternate embodiment for use of the versatile ambidextrous tool accessory pouch in the pet grooming environment.

FIG. 6 is a perspective view of an alternate embodiment for use of the versatile ambidextrous waist belt worn tool accessory pouch 60 in the pet grooming environment with brush/comb 71 attached by cable 74 via loop fastener 79.

Figure 7:
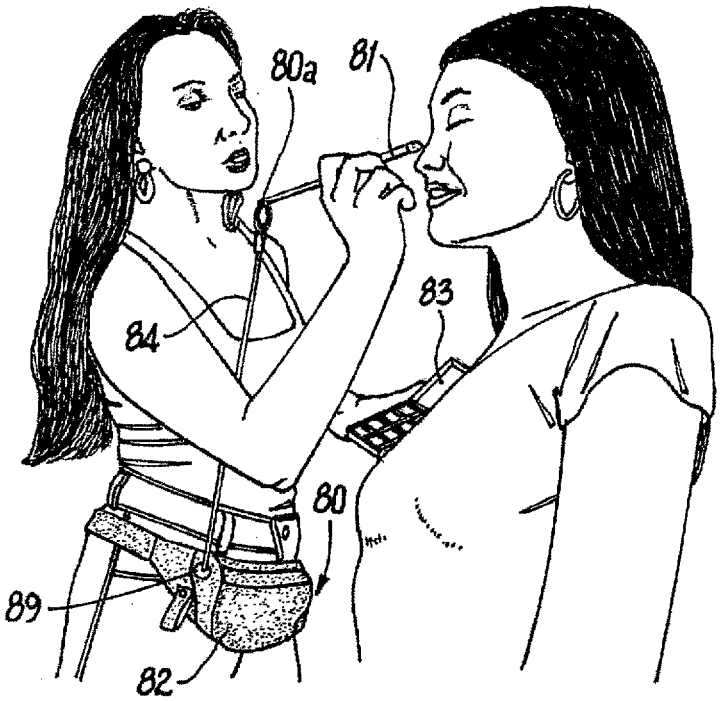
FIG. 7 is a perspective view of an alternate embodiment for use of the versatile ambidextrous tool accessory pouch in a cosmetic environment.

FIG. 7 is a perspective view of an alternate embodiment for use of the versatile ambidextrous waist belt worn tool accessory pouch 80 in a cosmetic environment, where the user uses makeup brush 81 attached by fastener 80*a* to retractable cable 84 through eyelet 89 of front 82 of pouch 80.

FIG. 8 is a perspective view of an alternate embodiment for use of the versatile ambidextrous waist belt worn tool accessory pouch 90 in a search and rescue night environment, where a selected primary tool flashlight 101 is the selected dominant hand tool, and is attached by fastener 100 to cable 104 extending through eyelet 109 of pouch 90. Secondary tool set of keys 121 is attached by fastener 120 on the other side of pouch 90.

FIG. 9 is a perspective view of an alternate recreational use embodiment for use of the versatile ambidextrous waist belt worn tool accessory pouch 130 for a hiker in a remote hiking environment, where a sweat wiping rag 146 is attached by fastener 140 to retractable cable 144 through eyelet 149 of pouch 130. FIG. 9 also shows an unrelated backpack 170.

Figure 10:
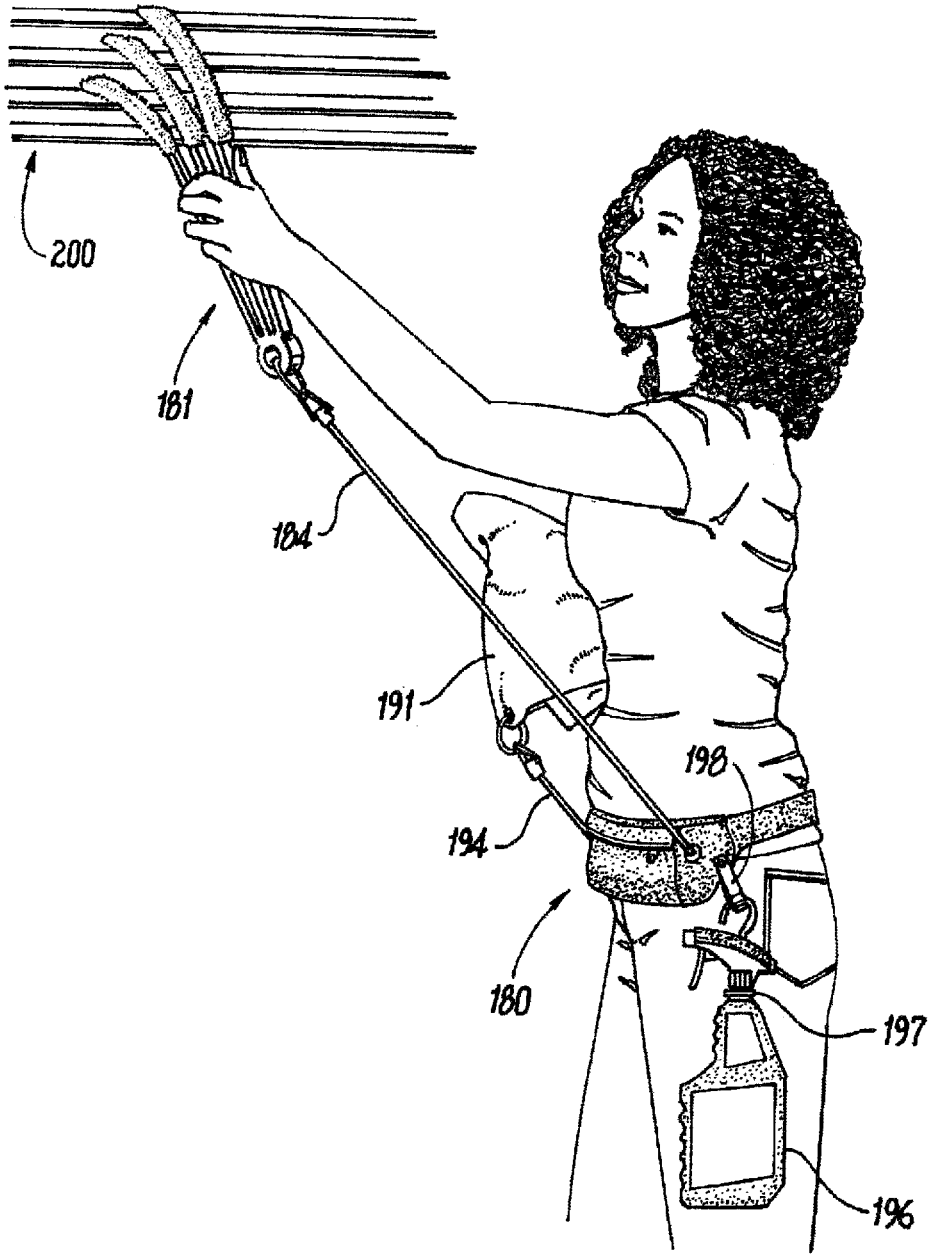
FIG. 10 is a perspective view of an alternate embodiment showing a cleaning worker using an extended handle duster with a retractable cable, where the duster is used for cleaning dust off of house interior surfaces, such as walls, counters, windows, window shades and/or Venetian blinds with the dominant hand, and the other side of the pouch having a cleaning rag suspended from a retractable cable on the secondary, non-hand dominant side of the pouch, and an optional bottle of spray cleaning fluid with a small collar around the neck of the bottle, the bottle being suspended from an exterior loop on one side of the pouch.

FIG. 10 shows an alternate embodiment showing a cleaning worker in a building cleaning service industry wearing an ambidextrous tool accessory pouch 180 and using with the user's dominant left hand an extended primary tool all-purpose duster 181 with a retractable cable 184, where the primary handle all-purpose duster 181 is used for cleaning dust off of house interior surfaces 200, such as walls, counters, windows, window shades and/or Venetian blinds with the dominant hand, and the other side of the pouch 180 having a secondary less frequently used tool such as a cleaning rag 191 suspended from a retractable cable 194 on the secondary, non-hand dominant side of the pouch 180, and an optional bottle 196 of spray cleaning fluid with a small collar 197 around the neck of the bottle 196, the bottle 196 being suspended by the collar 197 from an exterior loop 198 on one side of the pouch 180. Additionally, other tools for a cleaning worker can include house keys or other handheld cleaning accessories.

In summary, the pouch of the present invention is a versatile, ambidextrous pouch, worn in the front abdominal waist region of the user, where both right-handed and left-handed users can select a primary tool to be conveniently used straightforward from the side of the pouch closest to the user's dominant hand, without awkwardly reaching across the user's abdomen to uncomfortably manipulate the selected tool in an angular orientation.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

We claim:

1. A tool holder configured to house and provide ambidextrous and ergonomic access to a plurality of tools, said tool holder comprising:

a pouch, said pouch formed into an elongated shape with an interior compartment, and comprising: a zipper, said zipper configured to be zipped to enclose said interior compartment and be unzipped to create an opening to provide access to said interior compartment, said interior compartment formed to extend along an entire length of said pouch; said interior compartment of said elongated shape of said pouch configured to house the plurality of tools;

wherein said elongated shape of said pouch comprises: a substantially rectangular shape with a length being about two and one-half times longer than a height of said pouch, to thereby hold the plurality of brushes within said interior compartment in a horizontally oriented direction;

wherein said zipper extends substantially linearly across a top surface of said elongated pouch;

a waist belt, said waist belt configured to be secured around the waist of a user, and to centrally position said pouch at a front abdominal waist region of the user and to furthermore position an elongated direction of said elongated shape of said pouch transversely with respect to the front abdominal waist region of the user;

wherein said waist belt comprises: a first belt portion that extends away from an upper left-side portion of said pouch and a second belt portion that extends away from an upper right-side portion of said pouch, said waist belt thereby configured for said pouch to hang down from the waist region of the user when secured thereto, to provide ready access into said interior compartment using said linearly-oriented zipper;

a first eyelet, said first eyelet positioned on said pouch beyond a left-most distal end of said linearly extending zipper at a distal left side of said pouch;

a first tool tether arrangement comprising:

a first carabiner;

a cable;

a reel;

a second carabiner;

wherein said second carabiner is coupled to, and extends away from, said reel;

wherein said cable extends out from said reel and retractable within said reel, and said cable extends from outside of said compartment and passes through said opening, when said linearly oriented zipper is unzipped, and into said compartment, and then out through said first eyelet;

wherein a free end of said cable is secured to said first carabiner, said first carabiner configured to releasably couple to a first most frequently used tool;

a second eyelet, said second eyelet positioned on said pouch beyond a right-most distal end of said linearly extending zipper at a distal right side of said pouch;

a second tool tether arrangement comprising:

a first carabiner;

a cable;

a reel;

a second carabiner;

wherein said second carabiner of said second tool tether arrangement is coupled to, and extends away from, said reel of said second tool tether arrangement;

wherein said cable of said second tool tether arrangement extends out from said reel of said second tool tether arrangement and is retractable within said reel of said second tool tether arrangement, and said cable of said second tool tether arrangement extends from outside of said compartment and passes through said opening, when said linearly oriented zipper is unzipped, and into said compartment, and then out through said second eyelet;

wherein a free end of said cable of said second tool tether arrangement is secured to said first carabiner of said second tool tether arrangement, said first carabiner of said second tool tether arrangement being configured to releasably couple to a second most frequently used tool;

wherein said second carabiner of said first tool tether arrangement is configured to releasably couple to a third most frequently used tool;

wherein said second carabiner of said second tool tether arrangement is configured to releasably couple to a fourth most frequently used tool;

wherein said elongated shape of said pouch is configured to extend laterally across the front side of the user's waist, when supported by said waist belt at the front abdominal waist region of the user, to thereby position said first eyelet on a distal left side of the user, with said first carabiner of said first tool tether arrangement positioned on the distal left side of the user thereby being in close proximity to the left hand of the user, and to also thereby position said second eyelet on a distal right side of the user, with said first carabiner of said second tool tether arrangement positioned on the distal right side of the user thereby being in close proximity to the right hand of the user;

wherein said tool holder is thereby configured for use of the dominant hand of the user to access the most frequently used tool being positioned in proximity to the dominant hand, without having to reach across the front abdominal waist region of the user.

2. The tool holder according to claim 1, further comprising:

a first loop sewn to an interior wall on a left side of said compartment of said pouch, to releasably attach to said second carabiner of said first tool tether arrangement to releasably secure said reel of said first tool tether arrangement within said compartment, when the third most frequently used tool is not attached to said second carabiner of said first tool tether arrangement; and a second loop sewn to an interior wall on a right side of said compartment of said pouch, to releasably attach to said second carabiner of said second tool tether arrangement to releasably secure said reel of said second tool tether arrangement within said compartment, when the fourth most frequently used tool is not attached to said second carabiner of said second tool tether arrangement.

* * * * *